United States Patent [19]

Stary et al.

[11] 4,144,054

[45] Mar. 13, 1979

[54] PROCESS FOR THE REMOVAL OF IMPURITIES FROM ALUMINUM MELTS

[75] Inventors: Rudolf Stary; Adolf Howald, both of Neuhausen am Rheinfall, Switzerland

[73] Assignee: Swiss Aluminium Ltd., Chippis, Switzerland

[21] Appl. No.: 853,329

[22] Filed: Nov. 21, 1977

[30] Foreign Application Priority Data

Dec. 21, 1976 [CH] Switzerland ..... 16073/76

[51] Int. Cl.[2] ..... C22B 21/06

[52] U.S. Cl. ..... 75/68 R; 75/63; 75/93 R

[58] Field of Search ..... 75/68 R, 93 R, 93 E, 75/93 AC, 63

[56] References Cited

U.S. PATENT DOCUMENTS

| | | | |
|---|---|---|---|
| 3,753,690 | 8/1973 | Emley et al. | 75/68 R |
| 3,907,962 | 9/1975 | Ogiso | 75/68 R |

FOREIGN PATENT DOCUMENTS

| | | | |
|---|---|---|---|
| 1148344 | 4/1969 | United Kingdom | 75/68 R |

*Primary Examiner*—M. J. Andrews

*Attorney, Agent, or Firm*—Bachman & LaPointe

[57] ABSTRACT

The process for removing impurities, in particular for removing sodium chloride from aluminum melts, employs reactive chlorine which is introduced into the melt and then passes with the melt through a filter bed. Aluminum chloride formed by the reaction of the chlorine with the melt is chemisorbed on the chloride or group of alkali or alkali earth chlorides in the filter and the sodium in solution in the melt is in turn chemisorbed on the aluminum chloride thus reducing the sodium content of the melt.

10 Claims, 1 Drawing Figure

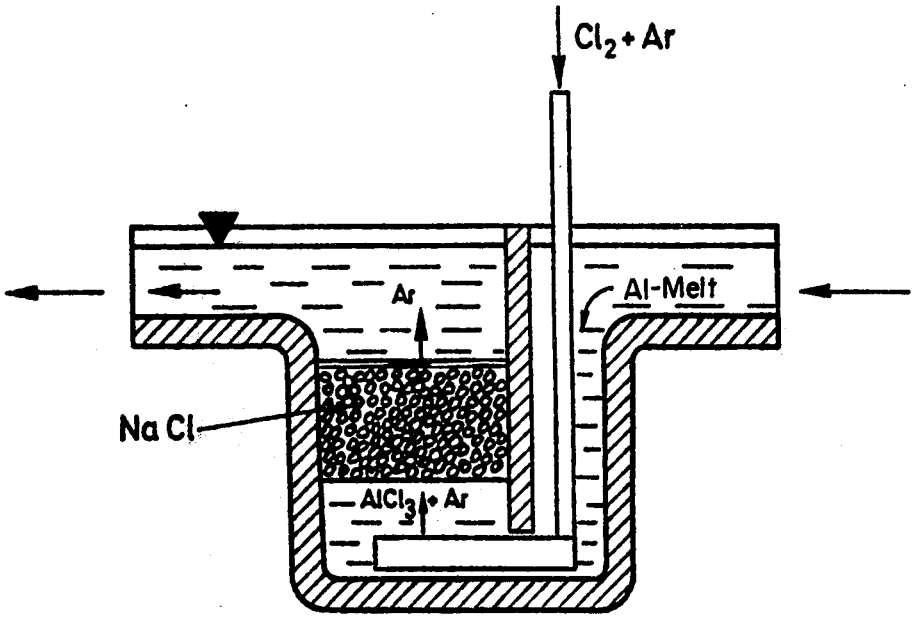
$Cl_2 + Ar$
Ar
Al-Melt
Na Cl
$AlCl_3 + Ar$

PROCESS FOR THE REMOVAL OF IMPURITIES FROM ALUMINUM MELTS

BACKGROUND OF THE INVENTION

The invention concerns a process for the removal of impurities, in particular for the removal of sodium, from aluminum melts by means of reactive chlorine in a filter bed.

It is known that by treating aluminum melts with reactive chlorine the sodium content of the melt can be lowered to a level of a few ppm. The chlorine is mainly supplied to the melt in the form of a gas mixture containing an inert carrier gas, which has the function of transporting the resultant sodium chloride to the surface of the melt and of lowering the hydrogen content of the melt by lowering the partial pressure of hydrogen. The use of gaseous chlorine is difficult in practice due to the fact that this gas is harmful to the health. For this reason, therefore efforts have been made for a long time to diminish the quantity of chlorine to be converted and, at the same time, to raise the efficiency of the chlorine by using a surface active substance in place of the gas. Thus for example German Pat. No. 815 106 describes a process by which materials, preferably active carbon or silica gel, which have active, chlorine-charged surfaces, are added to the melt by means of a special container, or if desired by means of a normal immersion bell.

U.S. Pat. No. 737,303 suggests a process in which the liquid aluminum is passed through a filter bed of refractory material, through which reactive chlorine is made to pass either periodically or continuously in the direction counter to the flow of the aluminum.

In German Pat. No. 1 912 877 a process for the treatment of aluminum melts is proposed, whereby the molten metal is covered with a flux which is in the liquid state at the temperature of the treatment and is able to bind to it the major part of the NaCl resulting from the chlorine treatment. The fluxes which are used for this purpose are salt mixtures which contain alkali or alkaline earth halides and additions of a complex salt such as sodium hexafluor aluminate or the like.

The processes described in German Pat. No. 1 912 877 and U.S. Pat. No. 3,737,303 viz., the covering of the melt with a flux and the use of filter beds made of refractory material, represent the state of the art today. Both processes however suffer from disadvantages which make them difficult to use in practice.

In the process wherein a flux is used to cover the aluminum melt, in time enrichment of aluminum chloride occurs in this cover layer, forming with the alkali and alkaline earth halides complex salts which can be hydrolyzed by moisture in the air, which causes undesirable smokey fumes to form, and can also cause the viscosity of this layer to increase. This smoke consists mainly of hydrochloric acid and finely divided aluminum oxide and aluminum hydroxide. There is also the danger that the molten salt and its hydrolyzed products will diffuse into the furnace lining which can lead to corrosion problems there.

Because the distribution of the chlorine in the melt is poor, the efficiency of chlorine is usually too low for industrial application; this is also so because relatively expensive foundry equipment is needed to carry out the process.

A better distribution of gas in the melt is achieved by using filter beds made of ceramic materials. The major part of the aluminum chloride, which results from the reaction of the chlorine with the aluminum, precipitates out on the ceramic, which prevents to a large extent the development of smoke. As a result of the ceramic material being covered on all sides, and the precipitation of aluminum chloride on to it from the melt, no hydrolysis of the aluminum chloride from moisture in the air occurs and therefore there is no need to worry about corrosion of the furnace lining. The capacity of the ceramic material to store the sodium chloride formed is relatively small which makes it necessary to employ a filter bed of adequate dimensions which has correspondingly large heat losses.

SUMMARY OF THE INVENTION

The object of the invention is therefore to develop a process for the treatment of aluminum melts with reactive chlorine, whereby the liquid aluminum is passed through a filter bed made of a material which has a high capacity for the storage of aluminum chloride.

This object is achieved by way of the invention in that the liquid aluminum is brought into contact with aluminum chloride which is chemisorbed on solid chlorides of the alkali and alkaline earth elements which have been formed in the aluminum melt by flushing with reactive chlorine, whereby the temperature of treatment is below the melting point of the chloride.

DESCRIPTION OF THE INVENTION

By "reactive chlorine" is meant not only elemental chlorine but also chlorine compounds (e.g. $C_2Cl_6$ or $CCl_4$) which are able to react with the molten aluminum to form aluminum chloride. By "aluminum" in this connection is meant both pure aluminum and alloys containing aluminum as the main component.

The chlorides formed in the filter bed can be pure chlorides or mixtures of chlorides of the alkali or alkaline earth metals. The use of sodium chloride is preferred. The grain size of the filter material is preferably 5 to 50 mm. Usefully the depth of the filter bed is at least 5 cm; e.g. 10–25 cm or more.

In a further, preferred version of the process of the invention, instead of particulate alkali or alkaline earth chlorides, a refractory material e.g. ceramic is employed, the surface of which is coated with the appropriate chloride or chloride mixture, for example by dipping into molten salt or into a concentrated aqueous salt solution. By using a refractory substrate there is the possibility, instead of employing a conventional filter bed (i.e. a filter bed made of particulate or granular material) of using sheets which are porous e.g. ceramic foam sheets or are provided with holes (channels) or also in the form of baffles arranged in filter pots.

In order to prevent salt particles from being swept along by the flowing melt it is useful to cover the filter bed with a filter which physically holds back such particles. This measure can be assisted by the construction of the filter bed in that the particle size of the filter material is reduced, layer-wise or continuously, in the direction of flow of the melt.

In order to maintain the aluminum chloride content at a minimum, gaseous chlorine can be introduced into the melt either continuously or periodically. It has been found advantageous to introduce, through the filter and parallel to the stream of chlorine, an inert gas such as argon or nitrogen.

The procedure for carrying out the process of the invention will now be explained in greater detail by means of an example and with the help of a drawing.

The drawing shows schematically a cross section through the experimental set up in the filter channel.

A 250 kg charge pf aluminum (99.85%) containing 15 ppm of sodium (average value) was melted in an oil-fired crucible furnace and brought to a temperature of 690–750° C. The melt was poured at a rate of 6 kg/min through a filter bed of the kind shown in the drawing and made of 2 kg sodium chloride of particle size 10 mm. The filter was continuously flushed with argon gas at 1 liter/min to which 1 liter/min of chlorine gas was added periodically for an interval of 5 min every 10 minutes. Both gases, as shown in the drawing, were passed through in the same direction.

The mode of function of the filter can be described as follows:

As soon as the chlorine enters the melt, it reacts with the aluminum and is converted to aluminum chloride. This resultant aluminum chloride is led, along with the melt, to the filter and is chemisorbed on or reacts with the sodium chloride according to the equation:

$$\times\ NaCl_{(s)} + y\ AlCl_{3(g)} \rightarrow (NaCl)_x \cdot (AlCl_3)_{y\,(s)}$$

The sodium in solution in the melt reacts in the active filter bed with the chemisorbed aluminum chloride in accordance with the equation:

$$3y\ Na + (NaCl)_x \cdot (AlCl_3)_{y\,(s)} \rightarrow (3y+x)NaCl_{(s)} + y\ Al_{(fl)}$$

It was possible therefore to reduce the sodium content of the aluminum melt purified this way to an average concentration of 2.5 ppm, which corresponds to a purification level of 83%. It is completely within the scope of the process of the invention to add further salts to the chloride or chloride mixture, provided the melting point of the salt mixture is not lowered to a level below the temperature of the liquid aluminum.

What is claimed is:

1. An improved process for the removal of sodium impurities from molten aluminum and aluminum alloy melts comprising:

providing a filter medium having an active surface, said active surface of said filter medium being composed of at least one solid metal chloride selected from the group consisting of alkali metal and alkaline earth metal chlorides;

fluxing said molten melt with reactive chlorine gas upstream of said filter medium so as to form aluminum chloride therein; and passing said molten melt through said filter medium wherein said aluminum chloride is chemisorbed on said active surface, the temperature of said molten melt being below the melting point of said active surface wherein said sodium impurities in said molten melt reacts with said chemisorbed aluminum chloride on said filter medium active surface so as to remove said sodium impurities from said molten melt such that said molten melt downstream of said filter medium is substantially free of said sodium impurities.

2. A process according to claim 1 wherein said at least one solid metal chloride on said filter medium active surface is comprised of sodium chloride.

3. A process according to claim 1 wherein said filter medium active surface is comprised of a mixture of alkali metal and alkaline earth metal chlorides.

4. A process according to claim 1 wherein said active surface of said filter medium is provided on a refractory substrate.

5. A process according to claim 4 wherein the refractory substrate is a ceramic foam sheet.

6. A process according to claim 4 wherein the refractory substrate is in granular form.

7. A process according to claim 1 wherein the particle size of the filter material of said filter medium is between 5 and 50 mm.

8. A process according to claim 1 wherein the temperature at which said process takes place is between 690 and 750° C.

9. A process according to claim 1 in which the filter medium is covered by a filter which physically filters the melt and prevents said at least one solid metal chloride from clinging to said melt after said melt has contacted said filter medium.

10. A process according to claim 1 wherein the particle size of the filter of said filter medium decreases layerwise or continuously in the direction of flow of the melt.

* * * * *